US005105753A

United States Patent [19]

Chih et al.

[11] Patent Number: 5,105,753

[45] Date of Patent: Apr. 21, 1992

[54] MULTI-PURPOSE UNDERWATER PROPELLING DEVICE

[76] Inventors: Liu P. Chih, No. 29, Lane 426, Oulong Street, Taipei City; Jack Hwang, No. 4, Lane 83, Huacheng Road, Hsinchuang, Taipei Hsien, both of Taiwan

[21] Appl. No.: 485,437

[22] Filed: Feb. 27, 1990

[51] Int. Cl.[5] ..... B63C 11/46

[52] U.S. Cl. ..... 114/315; 440/6

[58] Field of Search ..... 114/315, 211, 249, 242, 114/248, 283; 440/6

[56] References Cited

U.S. PATENT DOCUMENTS

| | | | |
|---|---|---|---|
| 1,285,659 | 11/1918 | Ford | 114/211 |
| 3,422,785 | 1/1969 | Strumor | 114/249 |
| 3,441,952 | 4/1969 | Strader | 440/6 |
| 3,450,908 | 6/1969 | Mabuchi | 440/6 |
| 3,614,937 | 10/1971 | Schulman | 114/283 |
| 3,757,721 | 9/1973 | Ohishi | 114/315 |
| 3,789,788 | 2/1974 | Peroni | 114/315 |
| 4,700,654 | 10/1987 | Borges | 440/6 |
| 4,864,959 | 9/1989 | Takamizawa et al. | 114/315 |

FOREIGN PATENT DOCUMENTS

| | | | |
|---|---|---|---|
| 454437 | 1/1950 | Italy | 114/315 |
| 125993 | 6/1986 | Japan | 440/6 |

*Primary Examiner*—Sherman Basinger
*Assistant Examiner*—Thomas J. Brahan
*Attorney, Agent, or Firm*—Leonard Bloom

[57] ABSTRACT

A multi-purpose aquatic propulsion device that may be utilized both with a water craft and separately therefrom. The device has an exhaust conduit including a check valve that permits the device to be utilized underwater. An arrangement is also provided for removably securing the housing under a water craft, whereby the propulsion device drives the craft while submerged.

5 Claims, 9 Drawing Sheets

MULTI-PURPOSE UNDERWATER PROPELLING DEVICE

FIELD OF THE INVENTION

The present invention relates to aquatic propulsion devices and, in particular, to multi-purpose underwater propelling devices that may be used either by grasping or by being attached under a water craft.

BACKGROUND OF THE INVENTION

The popularity of water sports that occur underwater (such as diving) and on the surface of water (such as boating and water skiing) has increased in recent years for recreational purposes (such as viewing underwater scenery) as well as sportive purposes (such as exercising). In conjunction with such activities, equipment, such as aquatic propulsion devices, are often utilized. Unfortunately, propulsion devices that are presently available are usable only for single purposes and are either too big, heavy and/or expensive for being used for multiple purposes. Further, such propulsion devices cannot be easily assembled/disassembled and/or transported. Finally, such propulsion devices often cannot be utilized amongst reefs.

Though not necessarily needed, the use of such aquatic propulsion devices aids the user thereof to conserve their physical energy and may even aid in removing the user thereof from danger, especially in the event of a loss of physical strength.

Accordingly, it can be seen that there remains a need for aquatic propulsion devices that are compact (so as to be able to be utilized amongst reefs) and that are able to be utilized for multiple purposes including being utilized either separately from a water craft or with a water craft, being positioned under the water craft so as to be submerged.

SUMMARY OF THE INVENTION

The primary object of the present invention is to provide a multiple use underwater propulsion device that is compact, relatively inexpensive and which may be readily assembled/disassembled.

It is another primary object of the present invention to provide such a multi-purpose underwater propulsion device that may be used both by itself to propel, i.e. a diver and, with a water craft by being easily secured to and removed from under a water craft, such as a rubber raft, where it is submerged and which device is easy to operate.

A still further object of the present invention is to provide a multi-purpose underwater propelling device that may be attached under a water craft, so as to permit the user thereof to operate the water craft while in both sitting and prostrate positions.

Yet another, object of the present invention is to provide a multi-purpose underwater propulsion device that may be grasped by a user during use thereof, such that the users physical strength may be conserved.

Another object of the present invention is to provide such a multi-purpose underwater propulsion device that facilitates underwater work or observation.

These and other objects of the present invention will become apparent from a reading of the following specification, taken in conjunction with the enclosed drawings.

BRIEF DESCRIPTION OF THE DRAWINGS

FIG. 3-1 is a cross section view of the exhaust conduit of the device of the present invention, enlarged for the sake of clarity.

FIG. 3-2 is an enlarged portion of FIG. 3.

FIG. 4-1 is a first embodiment of a use of the multi-purpose device of the present invention showing the steering means, including control linkage, provided along the bottom side of a water craft, which controls the orientation of the rudder for steering of the water craft.

FIG. 4-2 shows a water craft equipped with a transparent window that is located just below the rider's face, so that the viewing of underwater scenery is enhanced.

FIG. 5-1 is a second embodiment of a use of the multi-purpose device of the present invention in which the bow of a water craft is formed in the shape of a life ring and further in which the stern is shaped to form two buoys.

FIG. 5-2 illustrates a person utilizing the water craft of FIG. 5-1.

DESCRIPTION OF THE PREFERRED EMBODIMENTS

Figure 1:
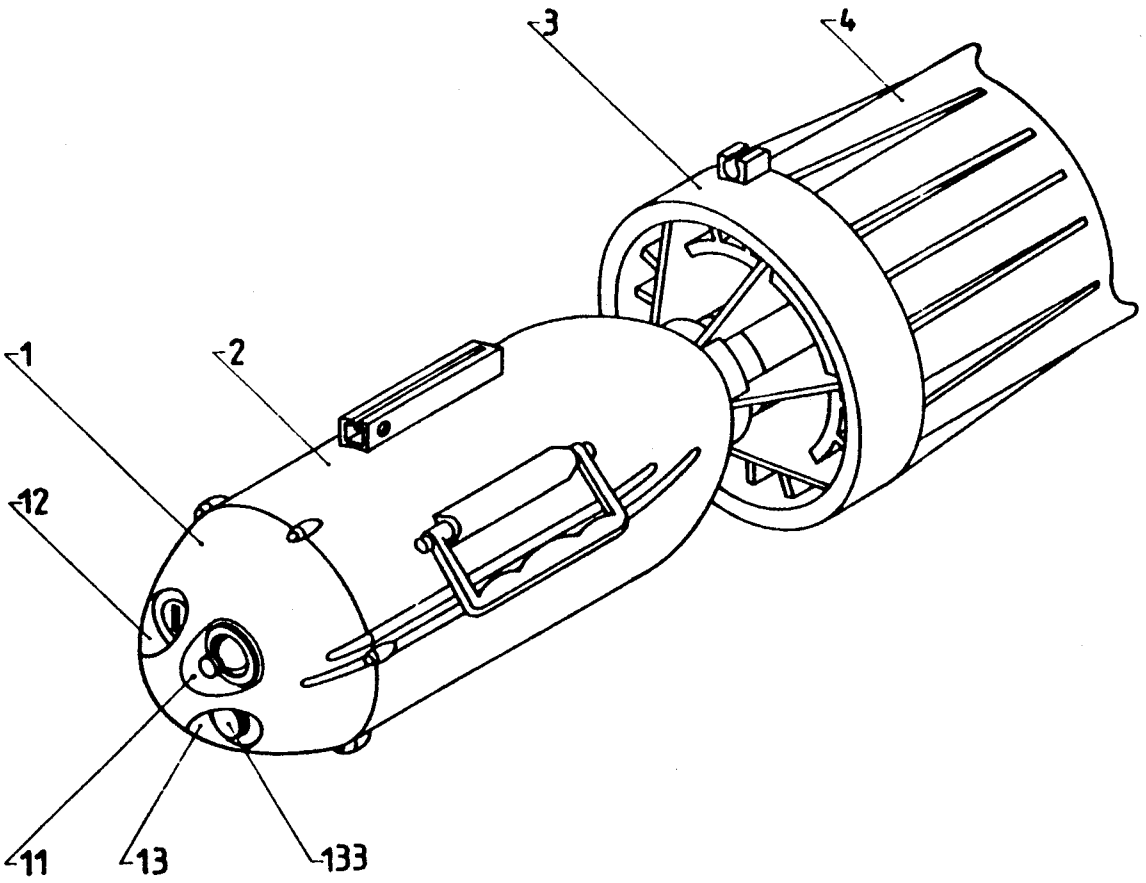
FIG. 1 is a perspective view of the multi-purpose underwater propulsion device of the present invention.

Referring now to the drawings, the present invention is an aquatic propulsion device in the form of a multi-purpose underwater propelling device D. The device D has an overall bomb-shaped structure (being substantially elongated cylindrical in shape) having a front cover 1, a main body 2, a guide ring 3 and a propeller shroud (propulsion cylinder) 4. The device D is, as shall be discussed at length below, equipped so as to be attached under a water craft (such as a raft) 5.

Figure 2:
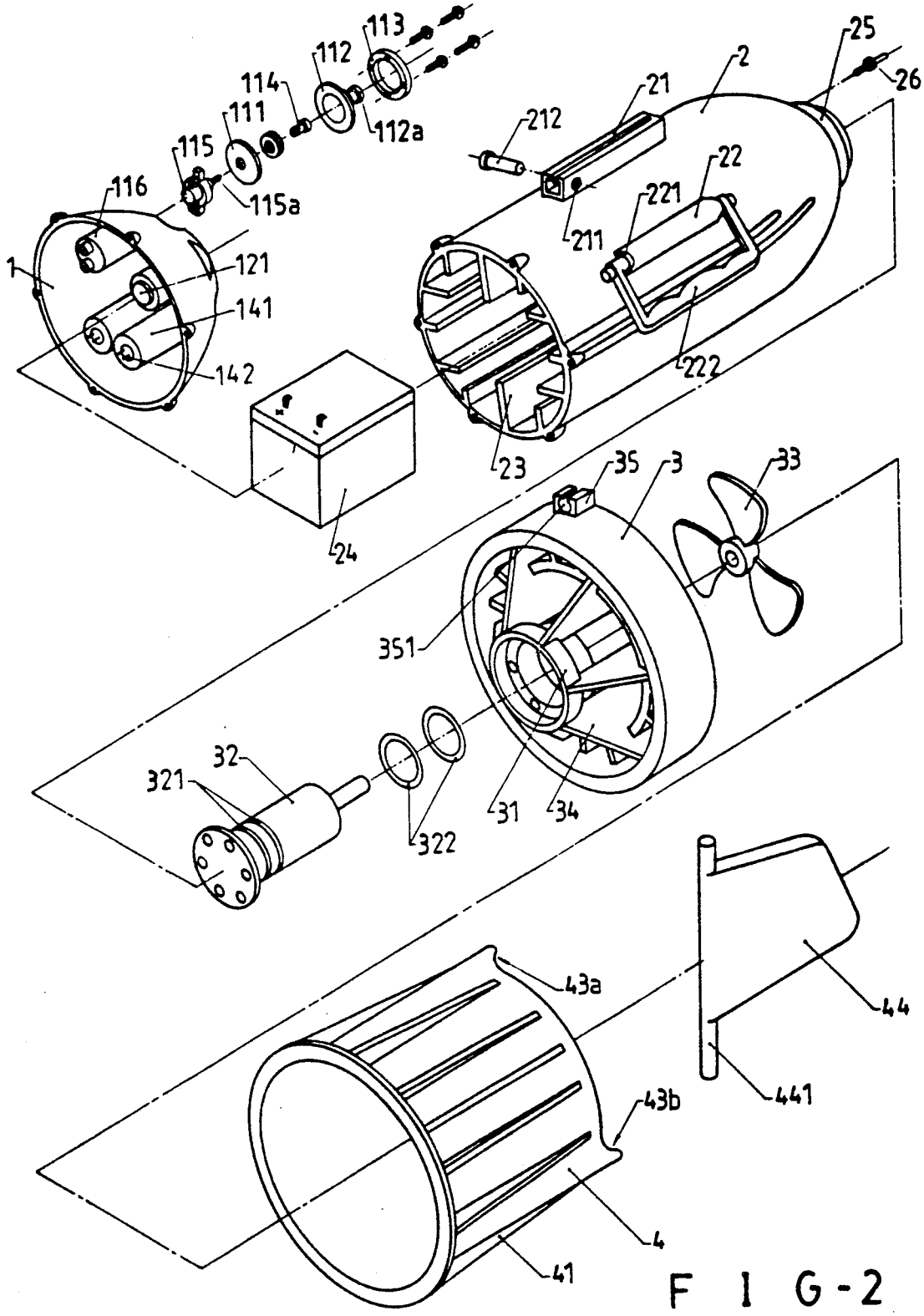
FIG. 2 is an exploded perspective view of the device of the present invention.
Figures 1, 2, 3:
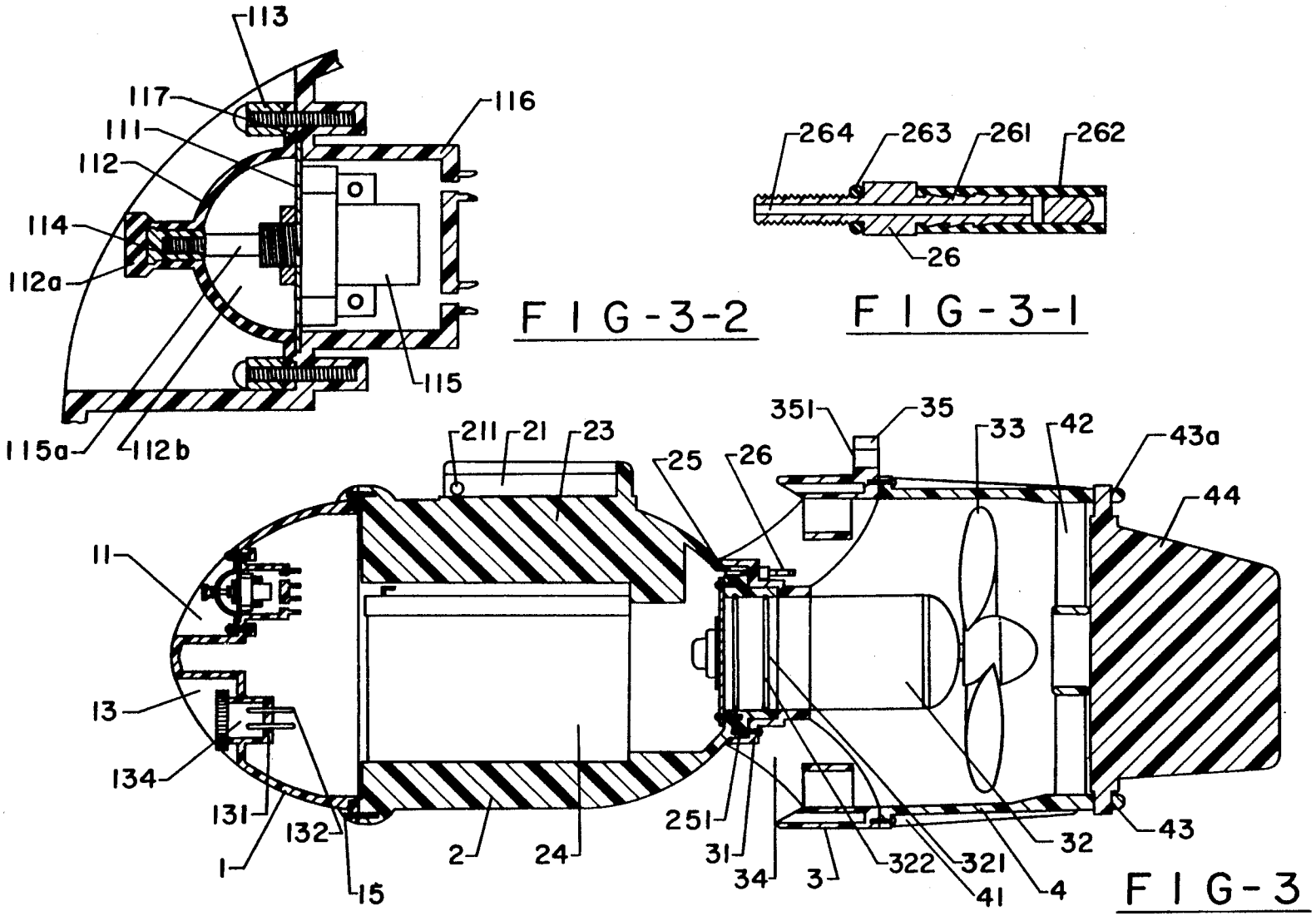
FIG. 3 is a cross-section view of the device of FIG. 1.

Referring now to FIGS. 1-3 and FIG. 3-2 (including FIG. 3-1), the front cover 1 of the device D is a semi-ellipsoidal-shaped structure. Formed in the front cover 1, and extending axially inwardly are a respective control depression (axially control dent) 11, indicating depression (indicating dent) 12, charging depression (charging dent) 13 and external connection depression (external connection dent) 14.

A circular plate 111 is disposed in the bottom end of the control depression 11. This circular plate 111 is covered by a conical (bowl)-shaped rubber water-tight cover 112. A ring plate 113 is used to tighten the cover 112 onto the bottom end of the control depression 11. The cover 112 is flexible, having a top end **112*a* that extends outwardly, so that an inner space 112*b* is defined thereunder. A screw nut 114 is disposed in the inner space 112B under cover 112. A control (on/off) switch 115** is fitted on the center of the circular plate 111 under the cover 112. The main body of this control switch 115 is housed (mounted) in a switch box 116 that is formed by the internal section of the control depression 11. An actuating handle 115*a* of the control switch 115 extends outwardly being connected to the cover 112 via the screw nut 114 that is also screwed on the handle 115*a*.

In the above manner, the control switch 115 is protected outside (against water, etc., from the surrounding ambient environment by the cover 112. In this fashion, a watertight control switch is provided.

The switch box 116 includes outgoing electrical paths or conduits that are connected to electric leads of the control switch 115. This connection is sealed by thermo-plastic material. Furthermore, a water sealing protrusion 117 is located about the periphery of the circular plate 111 and the bottom end surface of the control depression to attain an improved watertight seal.

A circular power indicating plate (watertight visual indicator) 121 is disposed in the bottom end of the indicating depression 12. This watertight visual indicator 121 is operatively associated with a battery 24 for visually indicating the status of the charging level of the battery 24.

The bottom end of the charging depression 13 has a concave portion (a circular concavity) 131 formed therein. Terminals 132 for electric' power connection are provided at the bottom of the concave portion 131. A watertight cover 133 is disposed over the front (external) end of the concave portion 131. In this manner, the terminals 132 form a watertight charging outlet. The charging outlet 132 is operatively associated with the battery 24 for electrically recharging the battery 24. Insertion of a watertight plug 134 of an external electric power recharging chord into the outlet 132, after the cover 133 has been removed, provides the battery 24, and hence the device, with electric power for any suitable purpose, such as propelling the device or for underwater illumination. It is contemplated herein, however, that the main function of the charging depression 13 will be as a charging current inlet part for an external electric power chord for charging or recharging the battery 24.

The bottom end of the external connection depression 14 likewise has a concave portion (a circular concavity) 141 formed therein. Electric power connection terminals 142 for electric power connection are provided at the bottom of the concave portion 141. A watertight cover 143 is also disposed over the top (external) end of the concave portion 141. In this manner, the terminals 142 form a watertight external connection outlet. This connection outlet is operatively associated with the motor of the device D for permitting the remote controlling of the operation of the motor. The external connection depression 14 is utilized to receive and connect therein an external remote control cable that extends from a remote location (such as the bow of a water craft), so that the operation of the propulsion device may be remotely controlled (i.e. switched on and off).

The rear end of the front cover 1 is provided with a plurality of protruding locking bosses 15 for securing (locking) the front cover 1 and the main body 2 to one another.

The main body 2 is a substantially cylindrical (tubular) structure. The front end of the main body 2 is locked onto the rear end of the front cover 1 via bosses 15. The aft (rear) portion of the main body 2 is formed having an ellipsoidal (or conical) shape.

Fixed on (integral with) the rear end of the main body 2 is a locking ring 25. Ring 25 is stepped, so that in cross-section it is L-shaped. The locking ring 25 has a plurality of connecting holes 251 formed therethrough, being spaced about the periphery thereof.

When assembled, the front cover 1 and the main body 2 form an elongated housing having a front portion, a rear portion and an interior (internal space).

The internal space within the main body 2 includes a plurality of inwardly-oriented internal radial fin plates 23 that are integral with the interior of the housing. Each fin plate 23 extends radially-inwardly from the internal wall of the main body 2 towards the center of the internal space (interior) of the main body 2. The fin plates 23 thus form an (rectangular) internal space that is sized to receive therein the battery unit 24. In this fashion, in this internal space the battery 24 is accommodated, being supported and firmly held in place by the fin plates 23 against movement. Also, since in such an arrangement there exists a large amount of space inside the main body 2 between the fin blades 23 after the battery unit 24 is installed, the body 2 can still provide the buoying necessary for the device D to operate, as well as to reduce the total weight of the device. This last feature improves the portability of the device D.

The battery unit 24 may include either a 12V, 9AH battery or two 12V, 6.5AH batteries, the space requirement for these two units being substantially the same. If a 12V, 9AH battery is used, it is able to last approximately 1.5 hours after charging and can drive the device D at a speed of about 4–5 m.p.h. During charging, external charging power passes to the battery unit 24 via the terminals 132 of the watertight charging outlet. The status of the power level of the battery unit 24 can be monitored from the indicating plate 121 of the watertight visual indicator.

To provide for removal (exhausting or venting) of gases, such as hydrogen and water vapors, from within the housing (resulting from charging and/or use of the battery) to the surrounding ambient environment, an exhaust conduit, including a check valve, 26 is formed in the rear portion (end) of the main body 2 of the housing. The rear portion of the conduit 26 has serrations 261 formed thereon. The rear portion of the conduit is covered by a flexible rubber tube 262, so that a watertight seal is formed therebetween. The forward end of the conduit is sealed by a watertight rubber ring 263. The exhaust conduit further includes an internal releasing passage 264 having side (sidewise) outlet openings formed therein near the front portion thereof. Preferably, the outlet openings are at substantially respective right angles to the passage 264. Finally, the check valve is in communication with the exhaust conduit, such that gases in the interior of the housing may be vented therefrom while fluids and gases from the surrounding environment are prevented from entering the interior of the housing. This permits the device D to be utilized beneath the surface of the water, such as when it is secured under a water craft.

A guide ring 3 is fixed on the ellipsoidal rear end of the main body 2, so as to be integral therewith. The guide ring 3 includes a stepped portion in the form of an axle ring 31 that mates with the stepped locking ring 25 of the main body 2. The interconnecting surfaces between the rings 25 and 31 are formed into mating step-shaped surfaces in order to achieve a firm connection and watertight seal therebetween. As will be seen, such a mating arrangement also provides a proper alignment of the locking ring 25 and the propeller shroud 4 relative to the housing.

An electric motor 32 is carried by the housing being mounted on the inside of an axle ring 31 so that an output shaft extends from the rear portion of the housing. The motor 32 has a pair of spaced circumferential (annular) grooves (troughs) 321 formed therein. Respective watertight rubber rings 322 are received in each groove 321 for achieving a watertight seal therebetween while clamping the motor 32 tightly in place inside of the axle ring 31. The output shaft (axle) of the motor 32 is provided with a propulsion means, such as a propeller 33, to drive the device D.

Means such as electrical wires (not shown) is provided for electrically connecting the battery to the motor 32 (of the propulsion means). In this manner electrical power is provided to the motor 32 of the propulsion means by the battery 24.

In the above manner, the propeller 33 of the propulsion means is operatively carried and driven by the output shaft, such that the motor 32 drives the propeller 33 for propelling the device D in the water.

The space defined between the guide ring 3 and the axle ring 31 is provided with a plurality of radial guiding plates 34 that extend rearwardly therefrom at respective inclined angles from the axle ring 31 toward the inner wall of the guide ring 3. In this fashion, the plates 34 from a plurality of passages which, during use thereof, easily guides water to flow through the guide ring 3 after passing over the side of the main body of the housing.

A propeller shroud (propelling cylinder) 4 is fixed (secured to) the rear end of the guide ring 3, so as to be surrounding the propeller 33. The shroud 4 include a plurality of elongated stabilizing fins 41 that are disposed being oriented axially. This orientation reduces water resistance, as well as strengthens the structure of the shroud 4.

The propeller shroud 4 is used primarily to house the propeller 33 for protecting the user thereof from injury that may result from contacting the propeller 33. Only a small clearance is defined between the outer periphery of the propeller 33 and the inner wall of the propelling shroud 4, so that the propeller 33 can be efficiently operated. A plurality of radial diversing plates 42 are disposed in the internal space at the rear portion of the shroud 4. Finally, an upper bore **43*a* and a lower bore 43*b* are formed at diametrically opposed locations in the rear end of the shroud 4**.

If desired the shroud 4 may also be provided with a plurality of elongated stabilizing fins formed on the outer surface thereof.

Bores **43*a* and 43*b* pivotably receive therein respective opposite ends of a rudder rod 441. Integral with the rudder rod 441 is a rudder 44, so that the rudder 44 is pivotably carried by the propeller shroud 4 rearwardly of the propeller 33. In this fashion, the orientation of the propeller 33** may be adjusted for steering the device.

Preferably, the rudder 44 is a detachable remote control rudder. This permits the device D to be utilized both with a water craft (when the rudder is attached) and separately (when the rudder is detached) therefrom. As shall be discussed at length herein, specific means are provided for controlling the adjustment of the orientation of the rudder 44, so that steering of the device is provided.

As noted above, the device D of the present invention is a multi-use device that may either be used with a water craft being submerged in water or separately therefrom.

In order to use the device D separately from a water craft (See FIG. 9), the outer surface of the main body 2 is provided having pair of spaced raised axial protrusions 22. The ends of the protrusions 22 have respective screw bores 221 formed therein. Ends of respective U-shaped handles 222 includes threaded protrusions 22 so that handles are provided. These handles 222 may then be gripped by a user when utilizing the device apart from a water craft. In such instances, the rudder 44 is also removed from the device.

In order to use the device D with a water craft (See FIGS. 4–8) an appropriate means is provided for removably securing the housing (and the device D) under the water craft, so that the propulsion device D may be removably secured under the craft, being submerged, and drives the water craft.

Figures 1, 4:
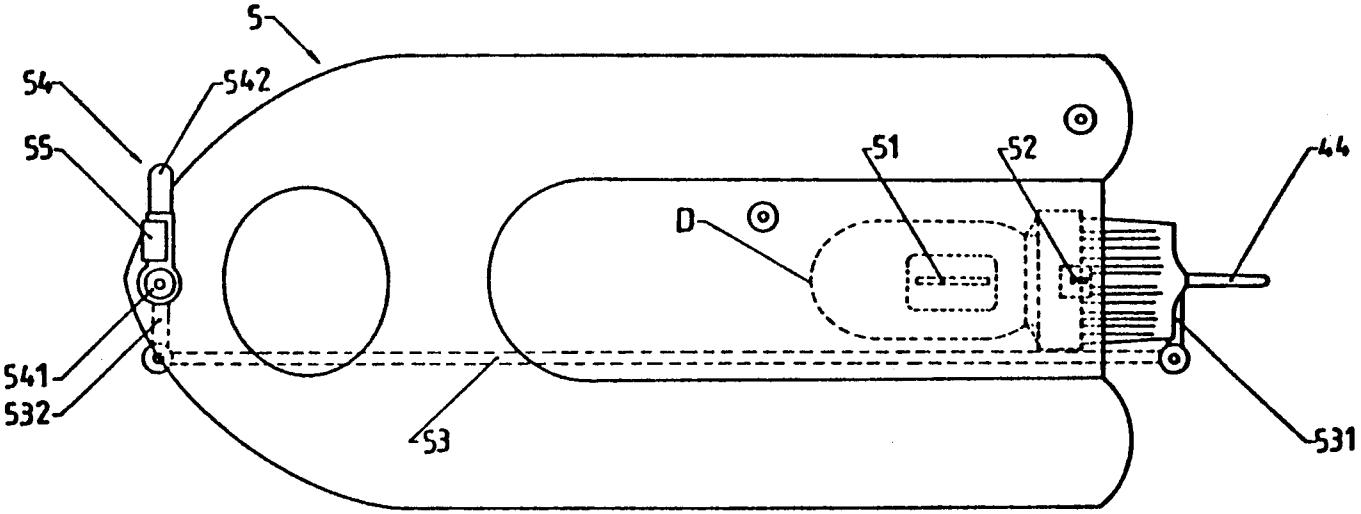
Figures 2, 4:
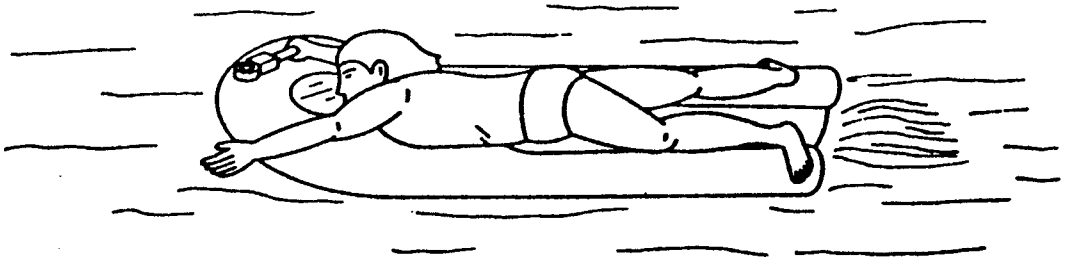

Referring now to FIGS. 4-1 and 4-2, the device D is illustrated submerged being used to drive (or push) an inflatable rubber raft 5. To secure the device D to the raft 5, the raft is equipped with a downwardly-extending hanging plate 51 and/or a downwardly-extending tie rod 52. The housing of the device D includes an axial hanging seat 21 that is joined on the main body 2 of the housing and/or a tie rod seat 35 that is formed on the guide ring 3.

The elongated axial hanging seat 21 has an open front end for removably receiving the hanging plate 51 therein. In this fashion, the hanging plate 51 may be received in the hanging seat 21. A pin 212 is then disposed across the open front end of the seat 21 being removably received in a through locking bore 211 for retaining the plate 51 therein. In this fashion, the plate 51 and the seat 21 may be removably secured together under the water craft 5, so that the housing of the device D is removably secured under the water craft 5 for use therewith while submerged.

The tie rod 35 has a trough bore 351 formed therein for removably receiving the tie rod 52 therein. In this fashion, the tie rod 52 and the tie rod seat 35 may be removably secured together under the water craft 5. This permits the housing of the propulsion device 5 to be removably secured under the water craft for use therewith while submerged.

The bottom side of the raft 5 is provided with a steering linkage (longitudinal steering control link) 53 that is part of the means for controlling the adjustment of the orientation of the rudder. The longitudinal steering control link 53 has a forward end and a rear end. The rear end of the link 53 is operatively pivotably connected to one end of a horizontal stern rod 531. The other opposite end of the stern rod 531 is fixed to the bottom end of the lower rudder rod 441. In this fashion, the orientation of the rudder 44 is controlled by the steering link 53.

The front end of the link 53 is pivotably joined to a horizontal rod 532. The other opposite end of the bow rod 532 is fixed to the bottom end of a vertical portion 541 of a rudder controller 54, that is fixed at the bow of the water craft 5. The vertical portion 541, after extending upwardly through the bow of the craft 5, is provided with a horizontal steering handle 542 (See FIG. 4-2). In this manner, the steering handle 542 is operatively associated with the forward end of the steering control link 53 such that manual manipulation by simply rotating the handle of the steering handle 542 moves and controls the orientation of the rudder 44, thereby providing steering means for controlling the orientation of the rudder 44, whether the user is in a sitting or prostrate position.

If desired, the topside of the handle 542 may be provided with a magnetic switch 55 having a cable connection extending to and connected with the external connection depression 14 of the device D which controls the operation (starting and stopping) of the motor 32.

Figures 1, 5:
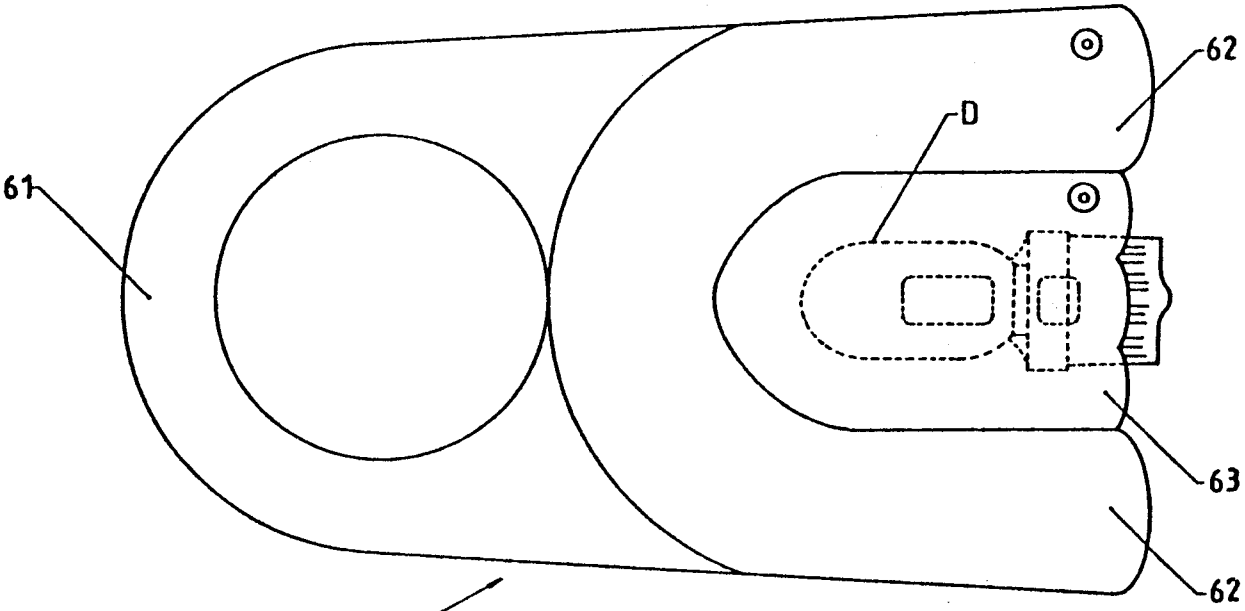
Figures 2, 5:
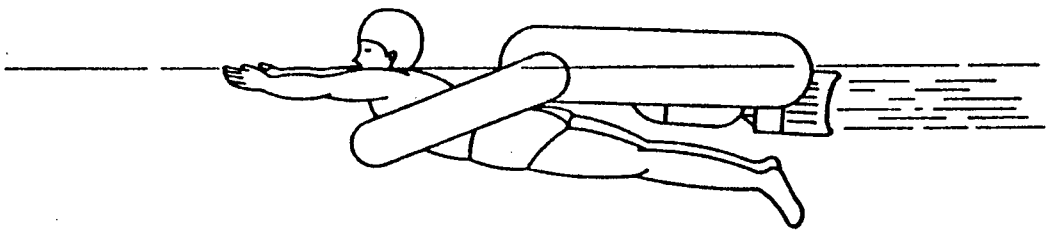

Referring now to FIGS. 5-1 and 5-2, the device 5 of the present invention may be mounted under an inflatable raft 6 that includes a life ring 61 (as the bow), a pair of long buoys 62 as the hull and stern and a rubber hanging bag 63 for supporting the propulsion means D. Since the user of this device will be submerged in water with their head out of the water, this combination may be utilized without a divers license.

Figure 6:
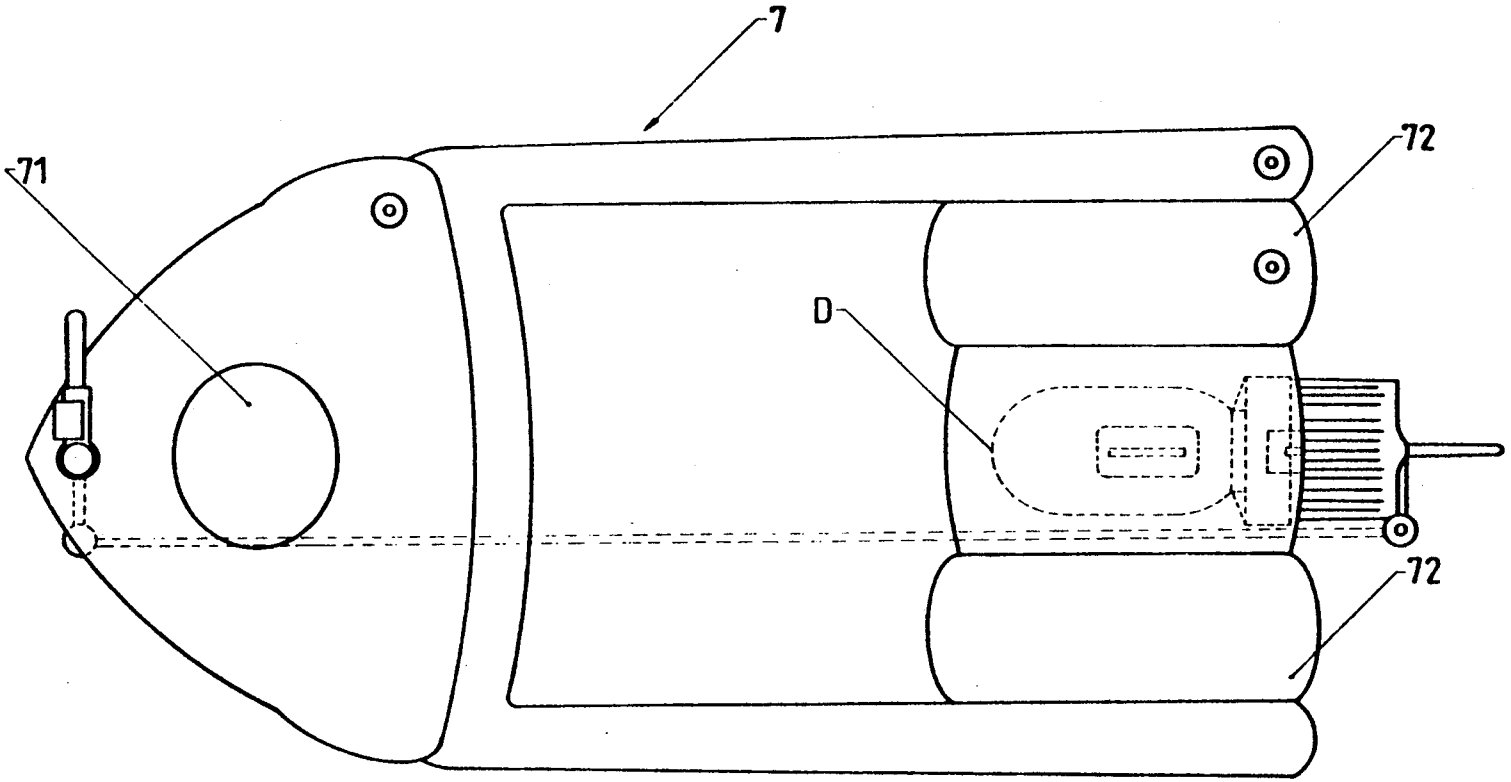
FIG. 6 is a third embodiment of a use of the multi-purpose device of the present invention.

Referring now to FIG. 6, another embodiment of a use of the device D is illustrated. In this embodiment, the bow of the craft 7 includes a transparent viewing window 71. Window 71 permits the observations of underwater scenery. The stern of the raft 7 includes two buoys 72 to compensate the additional buoyance of the device D. In such an arrangement, the user can observe underwater scenery through the window 71 without their head being submerged in the water.

Figure 7:
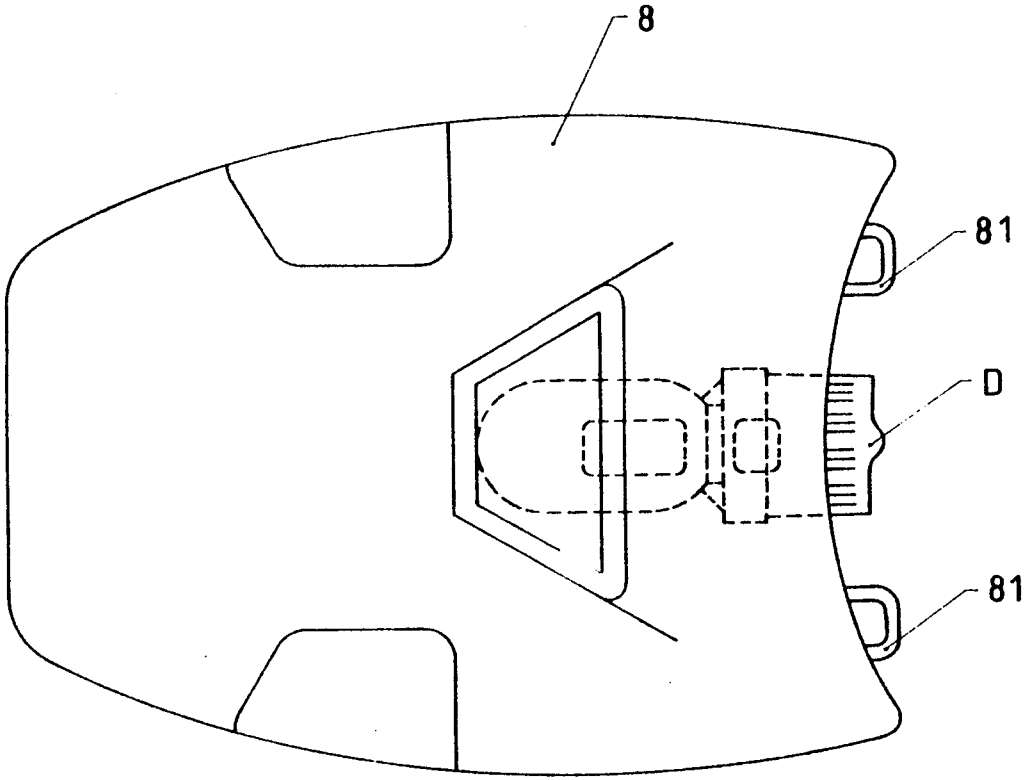
FIG. 7 is a top view of a fourth embodiment of a use of the multi-purpose device of the present invention.
Figure 8:
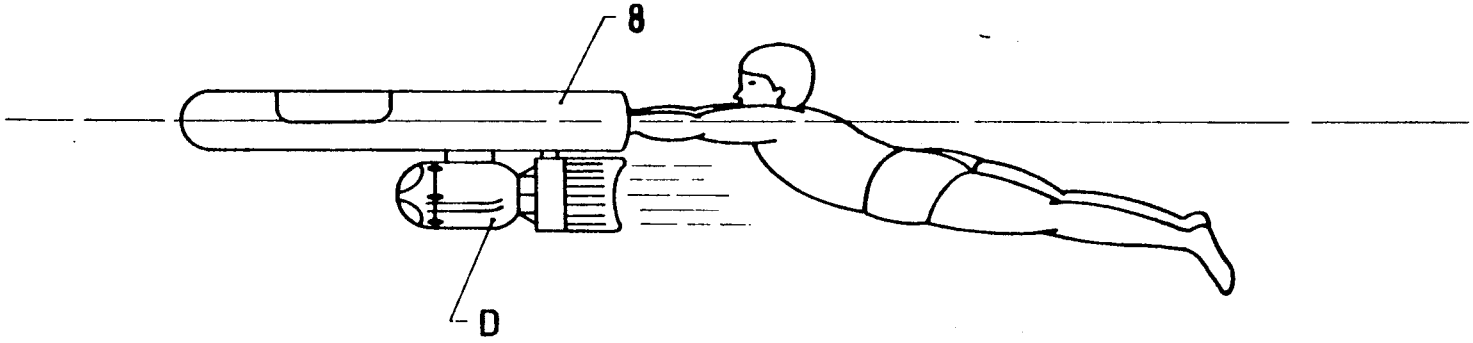
FIG. 8 shows the water craft of FIG. 7 being used for water sports activities.

Referring now to FIGS. 7 and 8, the craft 8 may be provided with handles 81 that the rider (user thereof) may grip during the use thereof.

Figure 9:
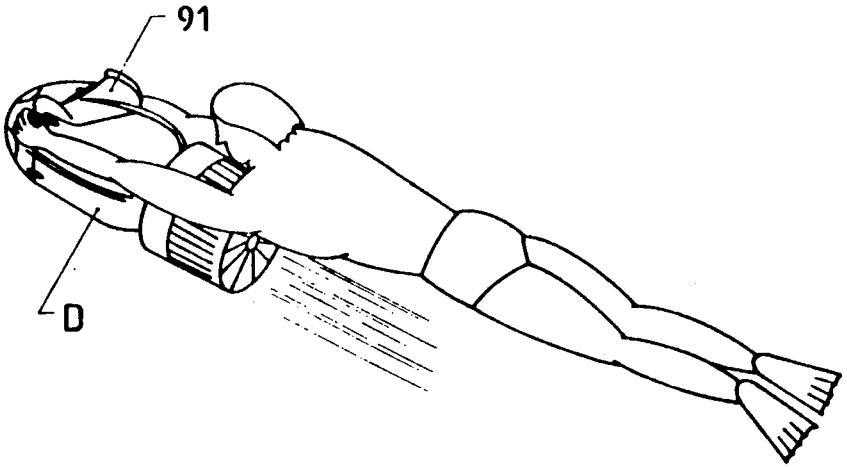
FIG. 9 is a fifth embodiment of a use of the multi-purpose device of the present invention, showing the device being utilized apart from a water craft by being grasped by a person during, i.e., driving.

With final reference now to FIG. 9, since the device D of the present invention is compact and light (weighing approximately 8 kg with the battery) and its interior is provided with plenty of hollow spaces to provide buoyancy, a diver can thus use the device D for diving by grasping the handles 91. In such a case, it is contemplated that the charging depression 13 well be used to connect the device D to an underwater illuminating device for underwater operation.

When assembled, the device D is completely watertight and all external (and internal) connections are fitted with watertight cables and plugs. Thus, the safety of the device D is assured.

In order to reduce the weight and cost of the device, as well as to increase safety and compactness for portability, only high-grade water resistant and strong plastic materials are utilized to fabricate the device.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A multi-purpose aquatic propulsion device, in combination, comprised of:

an elongated housing having a front portion and a rear portion, the housing further having an interior, the housing still further having formed in the front portion thereof a respective control depression, indicating depression, charging depression and external connection depression;

an electric battery disposed in the interior of the housing;

a guide ring integral with the rear portion of the housing;

an electric motor carried by the housing and having an output shaft extending from the rear portion of the housing, the electric motor being electrically connected to the battery, so that the battery provides the motor with electric power needed for the operation of the motor;

a propeller operatively carried and driven by the output shaft, such that the motor drives the propeller for propelling the device in the water;

a propeller shroud secured to the guide ring and surrounding the propeller, such that the user is provided with protection against contacting the propeller;

a watertight control switch operatively associated with the motor for controlling the operation of the motor, said control switch being disposed in the control depression;

a watertight visual indicator operatively associated with the battery for visually indicating the charging level of the battery, said visual indicator being disposed in the indicating depression;

a watertight charging outlet for receiving an external electric power recharging cord therein, the charging outlet being operatively associated with the battery for electrically recharging the battery, said charging outlet being disposed in the charging depression;

a watertight external connection outlet for receiving an external remote control cable, the external connection outlet being operatively associated with the motor for remotely controlling the operation of the motor, said external connection outlet being disposed in the external connection depression;

an exhaust conduit formed in the housing, the exhaust conduit including a check valve for venting gases released by the battery from the interior of the housing to the surrounding ambient environment and for preventing water from the ambient environment from entering the interior of the housing; and means for removably securing the housing under a water craft, whereby the propulsion device may be removably secured to and drives the water craft while submerged so that a multi-purpose aquatic propulsion device is provided that may be utilized both with a water craft and apart therefrom, said means including a downwardly-extending hanging plate carried by the water craft, an axial hanging seat carried by the housing, the axial hanging seat having an open front end for removably receiving the hanging plate therein, whereby the hanging plate and the hanging seat may be removably secured together under the water craft, a downwardly-extending the rod carried by the water craft and a tie rod seat carried by the guide ring, the tie rod seat having a trough bore formed therein for removably receiving and securing the tie rod therein, whereby the tie rod and the tie rod seat may be removably secured together under the water craft;

so that the propulsion device may be removably secured under the water craft either for use therewith while submerged or for use separately therefrom.

2. The multi-purpose aquatic propulsion device of claim 1, further comprised of:

a plurality of inwardly-oriented internal radial fin plates located in the interior of the housing and integral therewith, such that an internal space is defined in the interior of the housing for removably accommodating the battery, so that the battery is supported and firmly held in place in the interior of the housing by the fin blades against movement, and further so that the device is provided with additional buoyancy.

3. The multi-purpose aquatic propulsion device of claim 1, further comprised of:

a stepped locking ring integral with the rear portion of the housing, the guide ring including a respective stepped portion for mating with and being secured to the stepped locking ring, such that proper alignment of the locking ring and the propeller shroud relative to the housing is provided.

4. The multi-purpose propulsion device of claim 1, further comprised of:

a rudder pivotably carried by the propeller shroud rearwardly of the rudder, so that orientation of the rudder may be adjusted for steering the device; and means for controlling the adjustment of the orientation of the rudder, whereby steering for the device is provided.

5. The multi-purpose aquatic propulsion device of claim 4, wherein the means for controlling the adjustment of the orientation of the rudder includes a longitudinal steering control link having a forward end and a rear end, the rear end of the steering control link being operatively associated with the rudder, such that the orientation of the rudder is controlled thereby, and a steering handle operatively associated with the forward end of the steering control link, such that the manual manipulation of the steering handle moves and controls the orientation of the rudder for providing steering means for controlling the orientation of the rudder.

* * * * *